US008776330B2

(12) United States Patent
Keyaki et al.

(10) Patent No.: US 8,776,330 B2
(45) Date of Patent: Jul. 15, 2014

(54) END STOP FOR SLIDE FASTENER

(75) Inventors: Keiichi Keyaki, Toyama (JP); Shinya Honda, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 13/518,938

(22) PCT Filed: Dec. 25, 2009

(86) PCT No.: PCT/JP2009/071616
§ 371 (c)(1),
(2), (4) Date: Jun. 25, 2012

(87) PCT Pub. No.: WO2011/077553
PCT Pub. Date: Jun. 30, 2011

(65) Prior Publication Data
US 2012/0260470 A1 Oct. 18, 2012

(51) Int. Cl.
*A44B 19/38* (2006.01)

(52) U.S. Cl.
USPC ..... 24/435; 24/436; 24/434

(58) Field of Classification Search
CPC ..... A44B 19/36; A44B 19/26; A44B 19/386; A44B 19/38; A44B 19/60; A44B 19/384; A41H 37/003; B29C 65/08
USPC ..... 24/433, 436, 434, 432, 435, 389, 387
See application file for complete search history.

(56) References Cited

U.S. PATENT DOCUMENTS

| | | | | | |
|---|---|---|---|---|---|
| 2,312,045 | A * | 2/1943 | Morin | 24/435 |
| 2,563,454 | A * | 8/1951 | Brown | 24/435 |
| 2,884,691 | A * | 5/1959 | Rath et al. | 29/408 |
| 2,988,796 | A * | 6/1961 | Johns | 24/436 |
| 2,996,797 | A * | 8/1961 | Carlile | 29/408 |
| 3,254,384 | A * | 6/1966 | Plavin | 24/390 |
| 4,112,553 | A * | 9/1978 | Weitzner | 24/436 |
| 2008/0115337 | A1 * | 5/2008 | Ohgaku | 24/433 |
| 2009/0165266 | A1 * | 7/2009 | Deto | 24/434 |

FOREIGN PATENT DOCUMENTS

| | | | |
|---|---|---|---|
| JP | 4062620 | B2 | 3/2008 |
| JP | 2008-125737 | A | 6/2008 |

OTHER PUBLICATIONS

International Search Report and Written Opinion, PCT International Application No. PCT/JP2009/071616, mailed April 6, 2010.

* cited by examiner

*Primary Examiner* — Robert J Sandy
*Assistant Examiner* — Rowland Do
(74) *Attorney, Agent, or Firm* — Kilpatrick Townsend & Stockton LLP

(57) ABSTRACT

There is provided an end stop for a slide fastener, in which the attachment strength can be ensured irrespective of the size of the end stop, and a core can be firmly set to a setting position with respect to the end stop. The end stop has a base and a pair of legs which extend from the base, and the end stop is formed with a receptacle which is surrounded by the base and the pair of legs. The pair of legs have a pair of opening-side ends which are provided opposite to the base, and a pair of protrusions which are provided in the receptacle adjacent to the opening-side ends, the pair of protrusions protruding inward further than opposing surfaces of the pair of opening-side ends.

2 Claims, 11 Drawing Sheets

END STOP FOR SLIDE FASTENER

This application is a national stage application of PCT/JP2009/071616 which is incorporated herein by reference.

TECHNICAL FIELD

The present invention relates to an end stop for a slide fastener, and more particularly, to an end stop for a slide fastener, which is implemented as a top end stop or a bottom end stop, which is made of metal, the top or bottom end stop being attached to a fastener tape having a core on one edge by being connected to a fastener element, and having the function of stopping the slider that is sliding.

BACKGROUND ART

FIG. 10 depicts a top end stop 100 disclosed in Patent Document 1. The top end stop 100 is attached to enlarged cores, each of which is formed on a respective edge of fastener tapes. The top end stop 100 has a pair of legs 102 extending from both ends of a base 101, and is fastened to the core by crimping the pair of legs 102 in the state in which the core is received in a receptacle 103 that is surrounded by the base 101 and the legs 102. A stop portion 104, which protrudes from a respective leading end of the legs 102, serves to stop a slider that is sliding.

In addition, a projection 105, by which the core of the fastener tape is correctly positioned, is formed on the inner surface of the base 101. A cavity 106 is formed between the projection 105 and the respective base of the legs 102, and serves to facilitate the deformation of the core inside the receptacle 103 so that the core is trapped when the legs 102 are crimped. In addition, a plurality of protrusions 107 is formed on the inner surface of the legs 102, so that the core arranged inside the receptacle 103 is correctly trapped by the plurality of protrusions 107.

In addition, FIG. 11 depicts a bottom end stop 200 for a slide fastener, which is attached to cores of fastener tapes, disclosed in Patent Document 2. In the bottom end stop 200, after the cores 202 of the fastener tape 201 are inserted into openings formed in both sides of the bottom end stop 200, the cores 202 are held due to pressing, which is caused by deforming legs 204 of a lower plate 203 toward an upper plate 205, so that a slider that is sliding comes into contact with the bottom end stop 200. This, as a result, stops the sliding of the slider.

In addition, projections 207 are provided on both left and right sides of the base 206 in order to prevent the base 206 from being damaged when the lower plate 203 is deformed. Furthermore, a plurality of protrusions 209 and 210 is provided on the inner surface of the legs 204 of the lower plate 203 and legs 208 of the upper plate 205 in order to prevent the attached core from slipping from the bottom end stop 200.

PRIOR ART DOCUMENT

Patent Document

Patent Document 1: Japanese Patent No. 4062620 (FIG. 9)

Patent Document 2: Japanese Patent Application Publication No. 2008-125737 (FIG. 4)

SUMMARY OF INVENTION

Problems to Be Solved by Invention

However, recently, it is demanded that the attachment strength of the end stop for a slide fastener to the core be increased due to increased concern for safety. In particular, as for the end stops disclosed in Patent Documents 1 and 2, it is preferred that the amount of crimping the core be increased more reliably.

In addition, when fixing the end stop by crimping the end stop to the core using a crimping machine, the core is manually or automatically inserted into the receptacle of the end stop. Here, it is required for the core to be reliably positioned with respect to the end stop. When crimped, if the setting position is not reliably positioned, the appearance is inferior, and the aspect in which the protrusions are caught and brought by the core changes. Consequently, there is a probability that the strength decrease.

The present invention has been made keeping in mind the foregoing circumstances, and an object of the present invention is to provide an end stop for a slide fastener, in which the attachment strength to the core is improved and the core can be firmly set to the setting position with respect to the end stop.

Means for Solving Problems

The object of the present invention is achieved by the following configurations:

(1) An end stop for a slide fastener, comprising: a base; and at least one pair of legs which extend from the base, wherein the end stop is formed with a receptacle which is surrounded by the base and the pair of legs, wherein the pair of legs include: a pair of opening-side ends which are provided opposite to the base; and a pair of protrusions provided in the receptacle adjacent to the opening-side ends, the pair of protrusions protruding inward further than opposing surfaces of the pair of opening-side ends.

(2) The end stop for the slide fastener according to (1), wherein a distance between closest portions of the pair of protrusions is shorter than a diameter of a core of a fastener tape.

(3) The end stop for the slide fastener according to (1) or (2), wherein the pair of protrusions have inclined surfaces which are configured such that a distance therebetween gradually increases from the opening-side ends toward the base.

(4) The end stop for the slide fastener according to any one of (1) to (3), wherein the pair of legs further include a plurality of protrusions formed on opposing inner wall surfaces, the plurality of protrusions protruding inward from positions at a side of the base relative to the pair of protrusions.

(5) The end stop for a slide fastener according to (4), wherein the plurality of protrusions have other inclined surfaces which are configured such that a distance therebetween gradually decreases from the opening-side ends toward the base.

Advantageous Effects of Invention

According to the invention, the end stop for a slide fastener includes the base, the pair of legs, which extends from the base, and the receptacle, which is surrounded by the base and the pair of legs. The pair of legs has the pair of opening-side ends, which is provided opposite to the base, and the pair of protrusions, which is provided in the receptacle adjacent to the opening-side ends, and protrudes inward further than opposing surfaces of the pair of opening-side ends.

Accordingly, in the state in which the core is positioned in the setting position, the core can increase the contact area with the pair of protrusions, which protrudes further than the opposing surfaces of the opening-side ends, such that the core can be firmly set during crimping. Furthermore, since the pair of protrusions having the foregoing shape can sufficiently maintain the contact area with the core even after the crimping, the top end stop can strongly fix the core even if the size of the top end stop is small.

BRIEF DESCRIPTION OF DRAWINGS

FIGS. 3A to 3B are cross-sectional views depicting a process in which a core of a fastener tap is inserted into the top end stop, in which FIG. 3A shows the state before the core is inserted into the top end stop, FIG. 3B shows the state in which the core is passing by protrusions.

MODE TO CARRY OUT INVENTION

Hereinafter, an end stop for a slide fastener according to each embodiment of the present invention will be described in detail with reference to the accompanying drawings.

Figure 1:
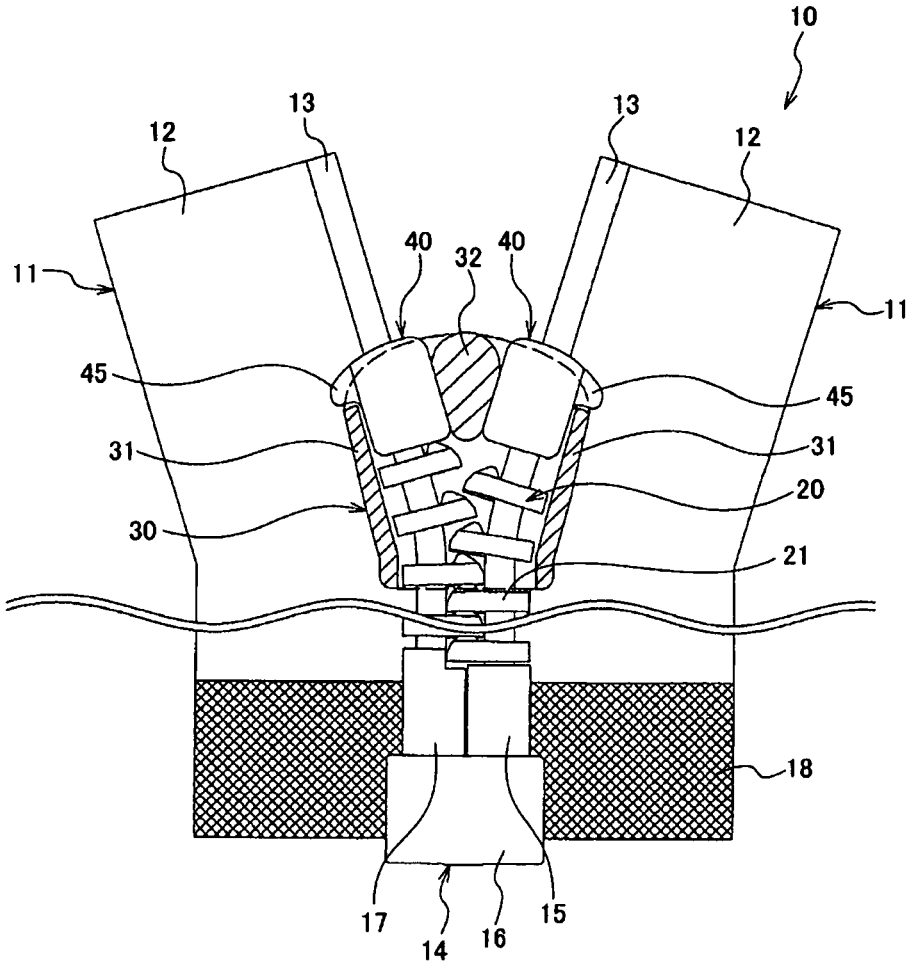
FIG. 1 is a front elevation view of a slide fastener to which a top end stop as an end stop for a slide fastener according to a first embodiment of the invention is applied.

FIG. 1 shows a slide fastener 10 to which a top end stop as an end stop for a slide fastener according to a first embodiment of the invention is applied. The slide fastener 10 includes a pair of left and right fastener tapes 11, a pair of left and right fastener element rows 20, the left fastener element row 20 being provided on the left fastener tape 11, the right fastener element row 20 being provided on the right fastener tape 11, and a slider 30, which causes the left and right fastener element rows 20 to engage with and disengage from each other. In response to the slider 30 being moved forward and backward, the left and right fastener element rows 20 engage with and disengage from each other.

The pair of left and right fastener tapes 11 includes a pair of tape members 12, which continuously extends in the lengthwise direction and is arranged in parallel in the width direction, and enlarged cores 13, each of which is provided on a corresponding one of opposing tape edges of the respective tape members 12. The enlarged cores 13 are thick in the inside and outside direction of the tape members 12. The respective tape member 12 may be implemented as a woven or knitted material. The respective core 13 is provided by weaving or knitting a core material thicker than the tape member 12 simultaneously with the tape member 12, which is woven or knitted.

Each of the pair of left and right fastener element rows 20 includes a plurality of fastener elements 21, and is mounted on the corresponding core 13 of the fastener tapes 11. In addition, a separable end stop 14, which serves to completely separate the pair of left and right fastener tapes 11 from each other, is provided on the lower portion of the pair of left and right fastener element rows 20. The separable end stop 14 has a box pin 15 and a box body 16, which are attached to one core 13 of the fastener tapes 11 in such a shape that the box pin 15 and box body 16 continue from the lower end of one fastener element row 20, and an insert pin 17, which is mounted on the other core of the fastener tapes 11 in such a shape that the insert pin 17 continues from the lower end of the other fastener element row 20. In FIG. 1, reference numeral 18 indicates a reinforcing tape.

In addition, a top end stop 40 is attached to a respective core 13 of the fastener tapes 11 in such a shape that the top end stop 40 continues from a respective upper end of the pair of left and right fastener element rows 20. The top end stop 40 is fabricated by die cast molding using a metal material, such as a zinc alloy or an aluminum alloy, or by a process performed in the order of extrusion, pressing, cutting and grinding.

Figure 2A:
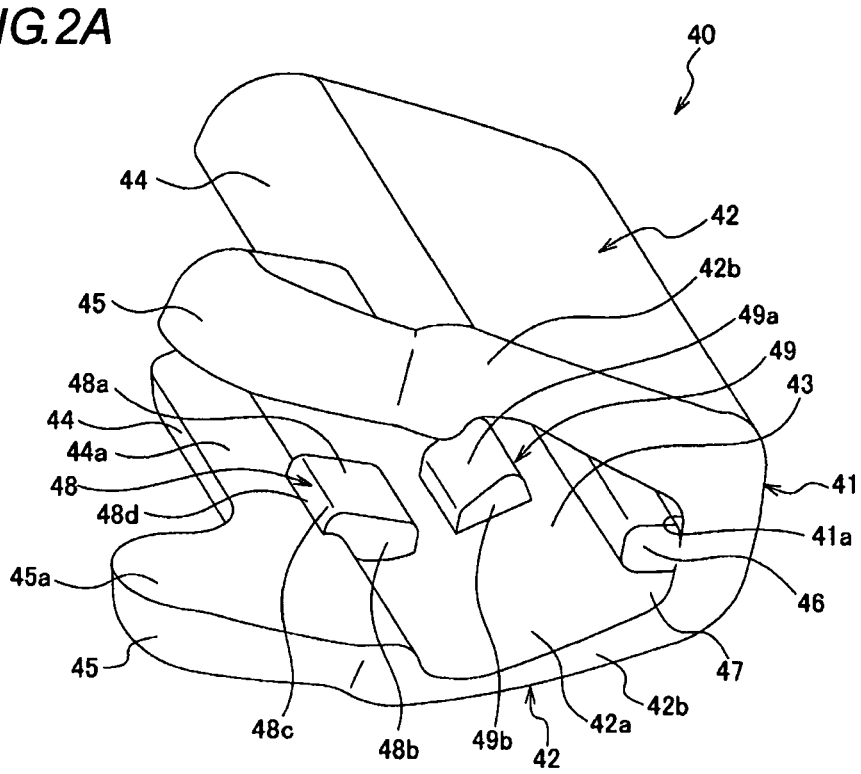
FIG. 2A is perspective views of the top end stop shown in FIG. 1.
Figure 2B:
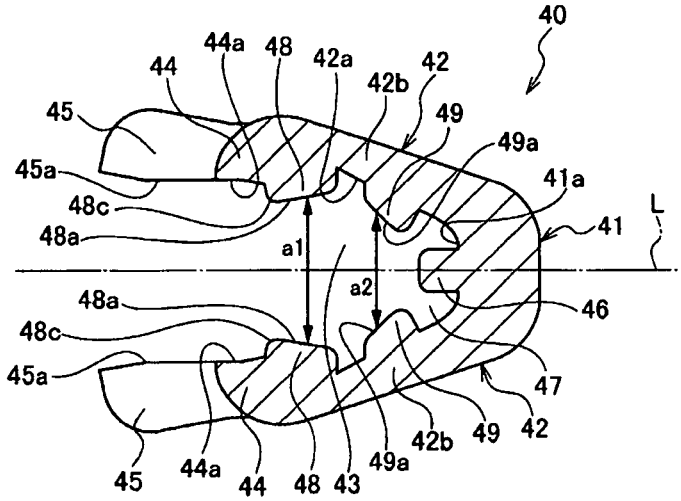
FIG. 2B is a cross-sectional of FIG. 2A.

As shown in FIGS. 2A and 2B, the top end stop 40 has a substantially U-shaped configuration, and includes a substantially flat base 41, which forms the central portion and has a predetermined length, a pair of legs 42, which extends in the same direction from the surface of the base 41 such that the legs 42 gradually expand from opposite longer edges of the base 41. Each of the legs 42 has an opening-side end 44 on one end thereof that is opposite to the base 41. That is, the cross-sectional shape of the top end stop 40 is symmetrical about line L that passes through the central portion of the base 41 such that the line L perpendicularly intersects the surface of the base 41 (see FIG. 2B). In addition, a receptacle 43, which is surrounded by the inner surface 41*a* of the base 41 and opposing inner wall surfaces 42*a* of the pair of legs 42, receives the cores 13 of the fastener tapes 11.

Each of the pair of legs 42 has a receptacle-defining portion 42*b* and the opening-side end 44. The receptacle-defining portion 42*b* is formed such that the thickness thereof gradually decreases from the base 41 toward the respective opening-side end 44. The opening-side end 44 continues from the receptacle-defining portion 42*b*, and is provided opposite to the base 41. The opening-side end 44 protrudes inward with respect to the receptacle-defining portions 42*b* such that the thickness increases, and has planar opposing surfaces 44*a*, which face each other.

A pair of stop portions 45 protrudes from the leading end of the pair of opening-side ends 44, and serves to stop the slider 30 by contact with flanges 31 (see FIG. 1) of the slider 30 that is sliding. The opposing surfaces 44*a* of the pair of opening-side ends 44 and the opposing surfaces 45*a* of the pair of stop portions 45 define a continuous shape that is substantially planar (see FIGS. 2A and 2B).

A narrow projection 46 having the shape of a line is provided on the inner surface 41*a* of the base 41, and extends continuously or intermittently across the entire length of the top end stop 40. A cavity 47, which is provided between the projection 46 and the respective base of the legs 42, defines a gap into which the respective core 13 can escape when the core 13 is deformed by being pressed.

In addition, on the inner wall surfaces 42*a* of the pair of legs 42, provided are a pair of protrusions 48 and a pair of protrusions 49. Each of the protrusions 48 is provided adjacent to the opening-side end of the receptacle 43, and protrudes inward further than the respective opposing surface of the pair of opening-side ends 44, that is, toward the opposite leg 42. Each of the protrusion 49 protrudes inward from the position at a side of the base 41 relative to the respective one of the pair of protrusions 48, that is, adjacent to the base of the receptacle 43. Here, the term "adjacent to the opening-side end of the recepticle 43" indicates the state of being more adjacent to the opening-side end than to the center C of the respective core 13, in the state in which the respective core 13 of the fastener tapes 11 is set to the receptacle 43 of the top end stop 40, as shown in FIG. 3C. The term "adjacent to the base of the receptacle 43" indicates the state of being more adjacent to the base than to the center C of the core.

As shown in FIG. 2B, the pair of protrusions 48 has a pair of inclined surfaces 48*a*, which are configured such that the distance al therebetween gradually increases from the opening-side ends 44 toward the base 41. In addition, the pair of protrusions 48 is shaped such that the distance a1 between the closest portions 48*c*, i.e. the most-protruding portions, that extend from the inclined surfaces 48*a* is shorter than the diameter a of the core 13 of the fastener tape 11. In addition, the pair of protrusions 49 has another pair of inclined surfaces 49*a*, which are configured such that the distance a2 therebetween gradually decreases from the opening-side ends 44 toward the base 41.

Figure 3A:
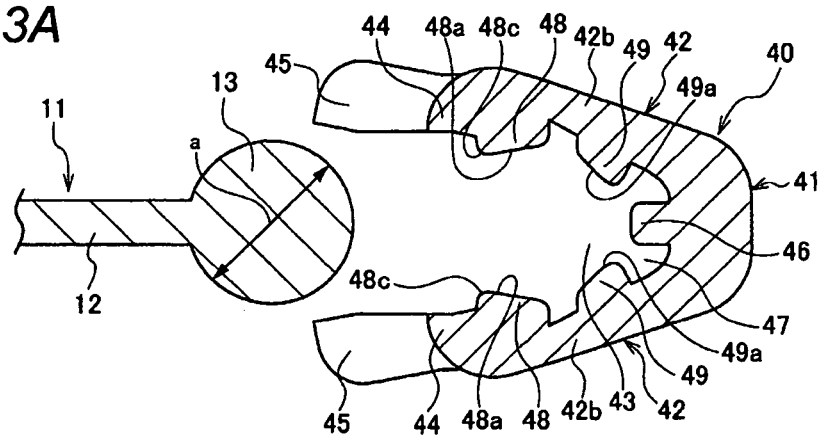
Figure 3B:
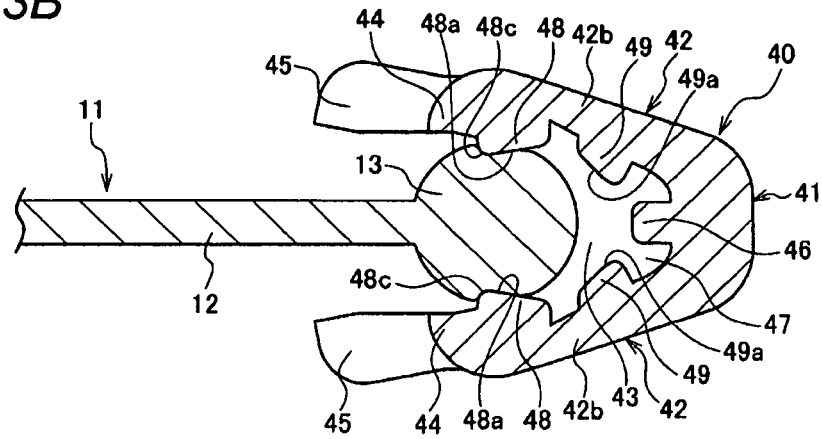
Figure 3C:
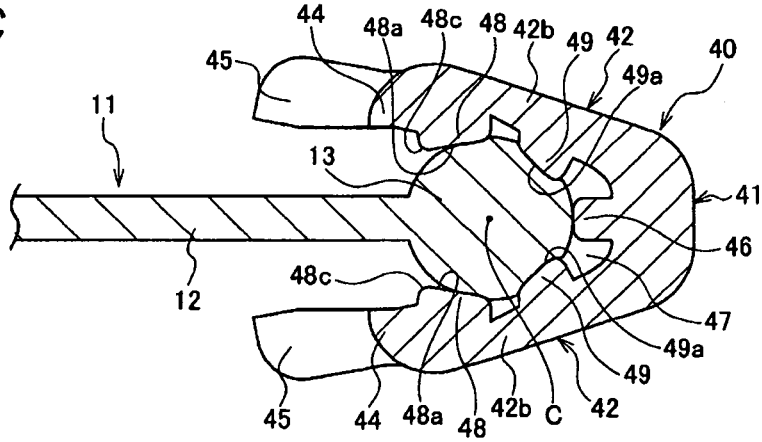
FIG. 3C shows the state in which the core has entered a receptacle.
Figure 4:
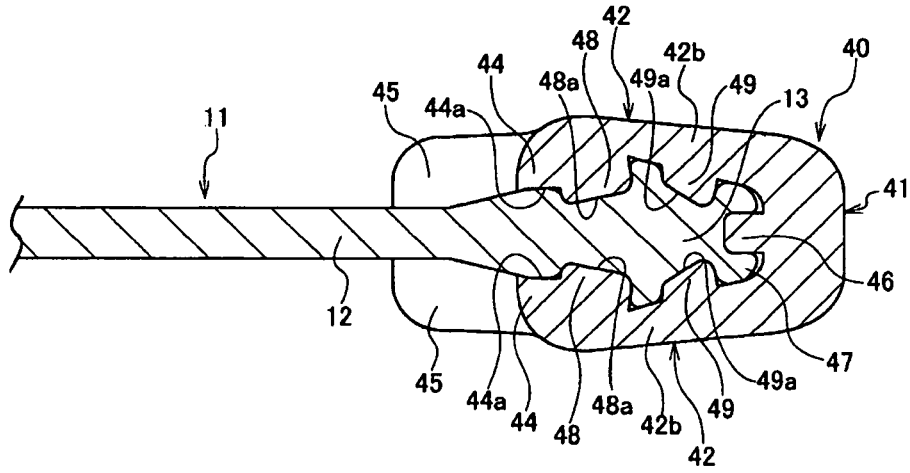
FIG. 4 is a cross-sectional view depicting the state in which the top end stop is attached to the core by being crimped.

The top end stop 40, which is configured as above, is strongly fastened to the core 13 by pressing the pair of legs 42 in the vertical direction so that the legs 42 are deformed, that is, crimping the legs 42, as shown in FIG. 3A. In detail, as shown in FIG. 3A, in the state in which the top end stop 40 is fixed to a crimping machine, the fastener tapes 11 are manually or automatically received into the receptacle 43 of the top end stop 40. In this process, the core 13 passes over the closest portions 48*c*, which are formed adjacent to the opening-side ends of the pair of protrusions 48, and moves to the setting position along the inclined surfaces 48*a* of the protrusions 48. Consequently, resistance to insertion temporarily increases when the core 13 is passing by the closest portions 48*c* of the pair of protrusions 48. After the core 13 has passed by the closest portions 48*c*, the core 13 can move to the setting position along the pair of inclined surfaces 48*a*, with a small amount of resistance to insertion.

In addition, as shown in FIG. 3C, the leading end of the core 13 abuts the projection of the base 41, so that the core 13 is correctly positioned in the setting position. In addition, when the core 13 is positioned in the setting position, the core 13 is in face contact with the respective inclined surface 48*a* of the pair of protrusions 48 and the pair of protrusions 49, and is partially in face contact with the respective lengthwise side surfaces 48*b* and 49*b* of the pair of protrusions 48 and the pair of protrusions 49 (see FIG. 2A), so that the core 13 is stabilized during the crimping. Since the distance al between the closest portions 48*c* of the pair of protrusions 48 is narrower than the diameter a of the core 13, the core 13 is urged toward the base 41 by the inclined surfaces 48*a* of the pair of protrusions 48, so as to be more firmly set.

Due to the crimping of the pair of legs 42 in the state shown in FIG. 3A, the top end stop 40 fastens the core 13 of the fastener tape 11. Consequently, the core 13 can escape and be received in the respective cavity 47 defined between the projection 46 and the respective base of the legs 42. Since not only the inclined surfaces 48*a* and 49*a* of the pair of protrusions 48 and the pair of protrusions 49 are in contact with the core 13 from both sides, but also the respective lengthwise side surfaces 48*b* and 49*b* of the pair of protrusions 48 and the pair of protrusions 49 (see FIG. 2A) are in contact with the core 13, it is possible to increase the amount with which the core 13 is crimped. In particular, since the pair of protrusions 48 protrudes inward further than the opposing surfaces 44*a* of the opening-side ends 44, the contact area between the side surfaces 48*b* and the core 13 increases, so that the protrusions 48 can more strongly fasten the core 13.

As described above, the top end stop 40 of this embodiment has the base 41 and the pair of legs 42 extending from the base 41. The top end stop 40 also has defined the receptacle 43, which is surrounded by the base 41 and the pair of legs 42. In addition, the pair of legs 42 includes the pair of opening-side ends 44, which is provided opposite to the base 41, and the pair of protrusions 48, which is provided adjacent to the opening-side end of the receptacle 43 and protrudes inward further than the opposing surfaces 44*a* of the pair of opening-side ends 44.

Consequently, in the state in which the core 13 is positioned in the setting position, the core 13 can increase the area, which is in contact with the pair of protrusions 48, which protrudes further than the opposing surfaces 44*a* of the opening-side ends 44, such that the core 13 can be more firmly set during the crimping. In addition, since the pair of protrusions 48 having the above-described shape can sufficiently maintain the contact area with the core 13 after the crimping, it is possible to strongly fix the core 13 even when the size of the top end stop 40 is small. Specifically, as for a standard, for example, in which whether or not the maintaining force of the top end stop 40 satisfies a reference is determined by suspending a weight from the bottom of the top end stop 40, in the state in which the slide fastener is fixed by directing the top end stop 40 downward, the top end stop 40 of this embodiment is sufficiently satisfactory even with a small size.

In addition, since the distance a1 between the closest portions 48*c* of the pair of protrusions 48 is smaller than the diameter a of the core 13, it is possible more firmly set the core 13, which is in the state of being positioned in the setting position, by urging the core 13 toward the base 41 using the inclined surfaces 48*a* of the pair of protrusions 48.

In addition, since the inclined surfaces 48*a* of the pair of protrusions 48 are formed such that the distance al therebetween gradually increases from the opening-side ends 44 toward the base 41, it is possible to move the core 13 to the setting position along the pair of inclined surfaces 48*a*, in the state in which resistance to insertion is small.

Furthermore, since the pair of protrusions 49, which is more adjacent to the base than the pair of protrusions 48 and protrudes inward, is provided on the opposing inner wall surfaces 42*a* of the pair of legs 42, the core 13, which is in the state of being positioned in the setting position, can increase the contact area due to the pair of protrusions 49. Consequently, it is possible firmly set the core during the crimping. In addition, since the core 13 can sufficiently maintain the contact area with the pair of protrusions 49 even after the crimping, it is possible to strongly fix the core 13 even when the size of the top end stop 40 is small.

In addition, since the pair of protrusions 49 has another pair of inclined surfaces 49*a*, which are configured such that the distance a2 therebetween gradually decreases from the opening-side ends 44 toward the base 41, another pair of inclined surfaces 49*a* can be in contact with an arc surface in the leading end of the core 13 in the state in which the core 13 are positioned in the setting positions. Consequently, it is possible to more firmly set the core 13.

Figure 5A:
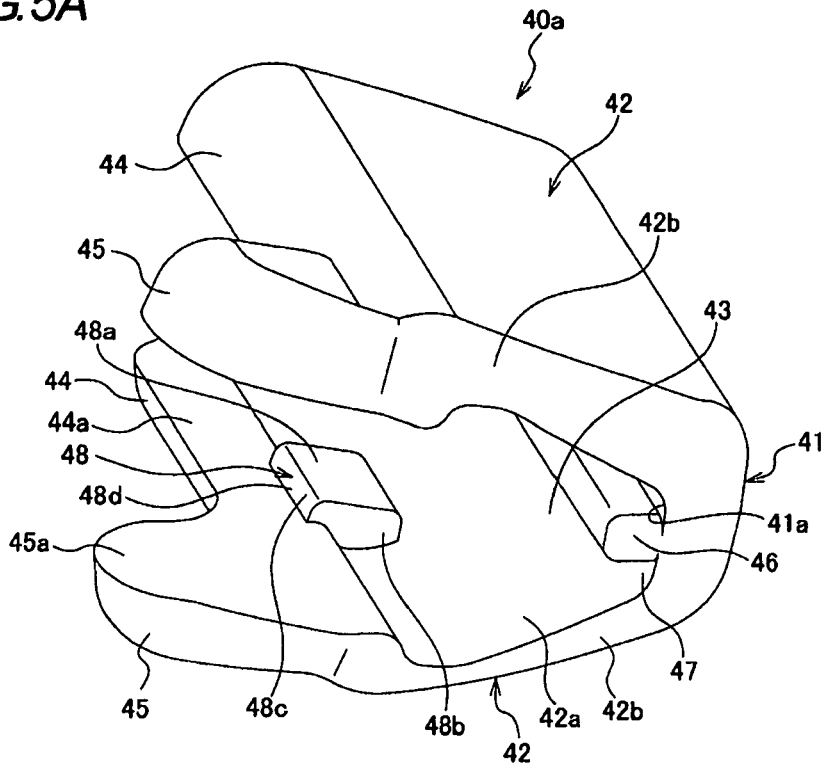
FIG. 5A is a perspective view of a variation of the top end stop according to the first embodiment.
Figure 5B:
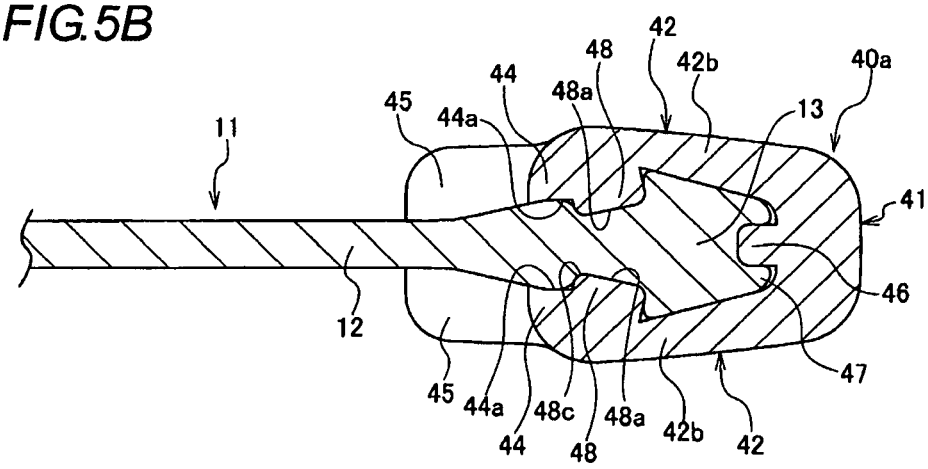
FIG. 5B is a cross-sectional view showing the state in which the top end stop in FIG. 5A is attached to the core by being crimped.

As a variation of the first embodiment, like a top end stop 40*a* shown in FIGS. 5A and 5B, the pair of legs 42 may not have the pair of protrusions 49. Even in this case, in the state in which the core 13 is positioned in the setting positions, the contact area between the core 13 and the pair of protrusions 48 can be increased, such that the core 13 can be firmly set during the crimping. In addition, since the pair of protrusions 48 can sufficiently maintain the contact area with the core 13 after the crimping, it is possible to strongly fix the core 13.

Figure 6A:
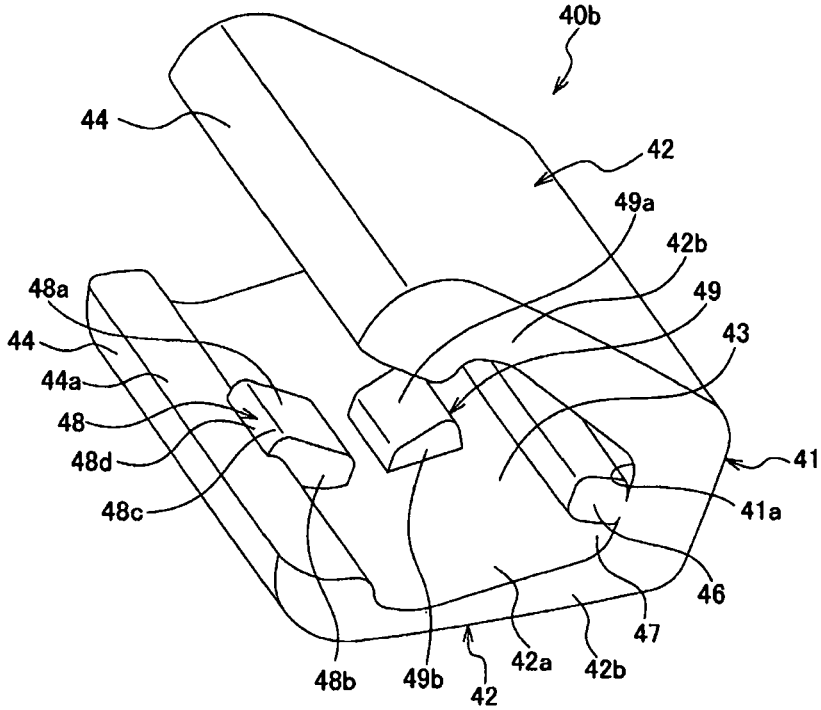
FIG. 6A is a perspective view of another variation of the top end stop according to the first embodiment.
Figure 6B:
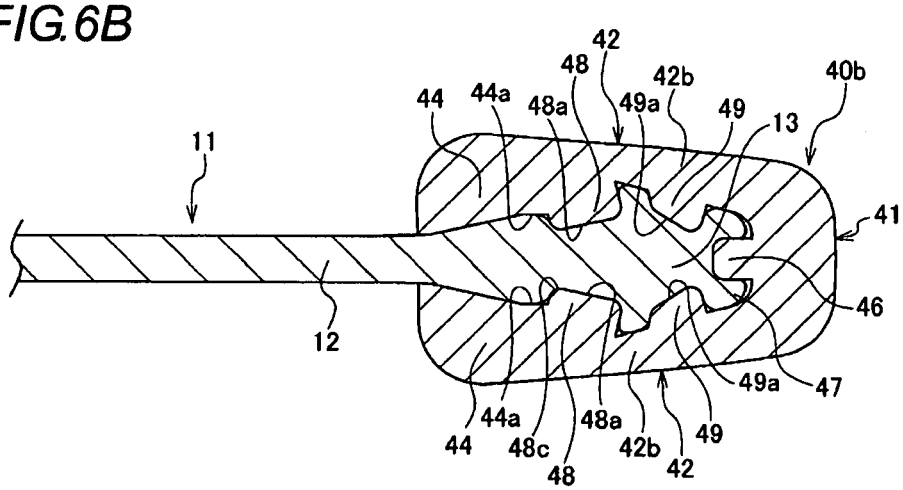
FIG. 6B is a cross-sectional view showing the state in which the top end stop in FIG. 6A is attached to the core by being crimped.

In addition, as another variation of the first embodiment, like a top end stop 40*b* shown in FIGS. 6A and 6B, the pair of legs 42 may not have the pair of stop portions 45. In this case, when the slider 30 is sliding, the base 41 in one side of the top end stop 40*b* that has passed by a guide post 32 comes into contact with one opposite fastener element 21 or the base 41 in the other side of the top end stop 40*b*. Due to this contact, the engagement between the fastener elements 21 becomes impossible, thereby stopping the slider 30 from sliding. When the size of the top end stop 40*b* is great with respect to the opening of the slider 30, which enters and exits in the state in which the fastener elements 21 are separated, the sliding operation of the slider 30 may be stopped due to the contact between the top end stop 40*b* and the opening.

[Second Embodiment]

Figure 7:
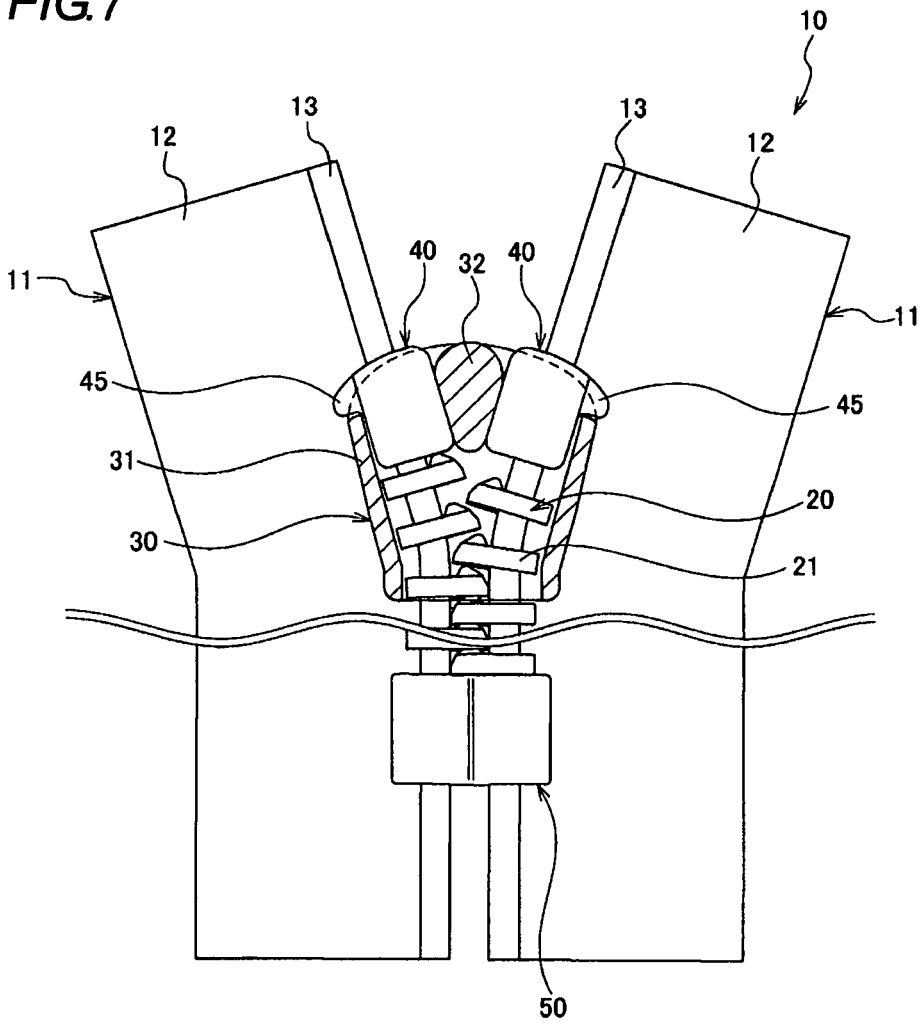
FIG. 7 is a front elevation view of a slide fastener to which a bottom end stop as an end stop for a slide fastener according to a second embodiment of the invention is applied.

FIG. 7 is a front elevation view of a slide fastener to which a bottom end stop 50 as an end stop for a slide fastener according to a second embodiment of the invention is applied, in place of the separable end stop 14 according to the first embodiment. The same reference numerals will be used to designate components equivalent to those of the first embodiment, and descriptions thereof will be omitted or simplified.

Figure 8:
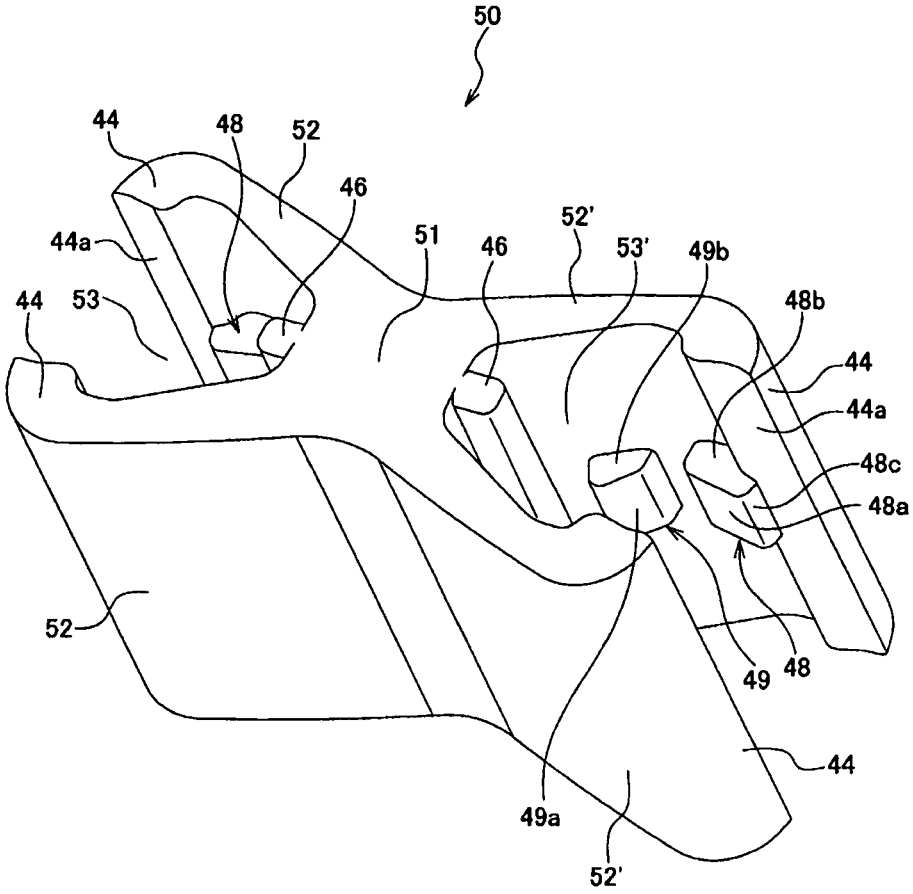
FIG. 8 is a perspective view of the bottom end stop shown in FIG. 7.
Figure 9:
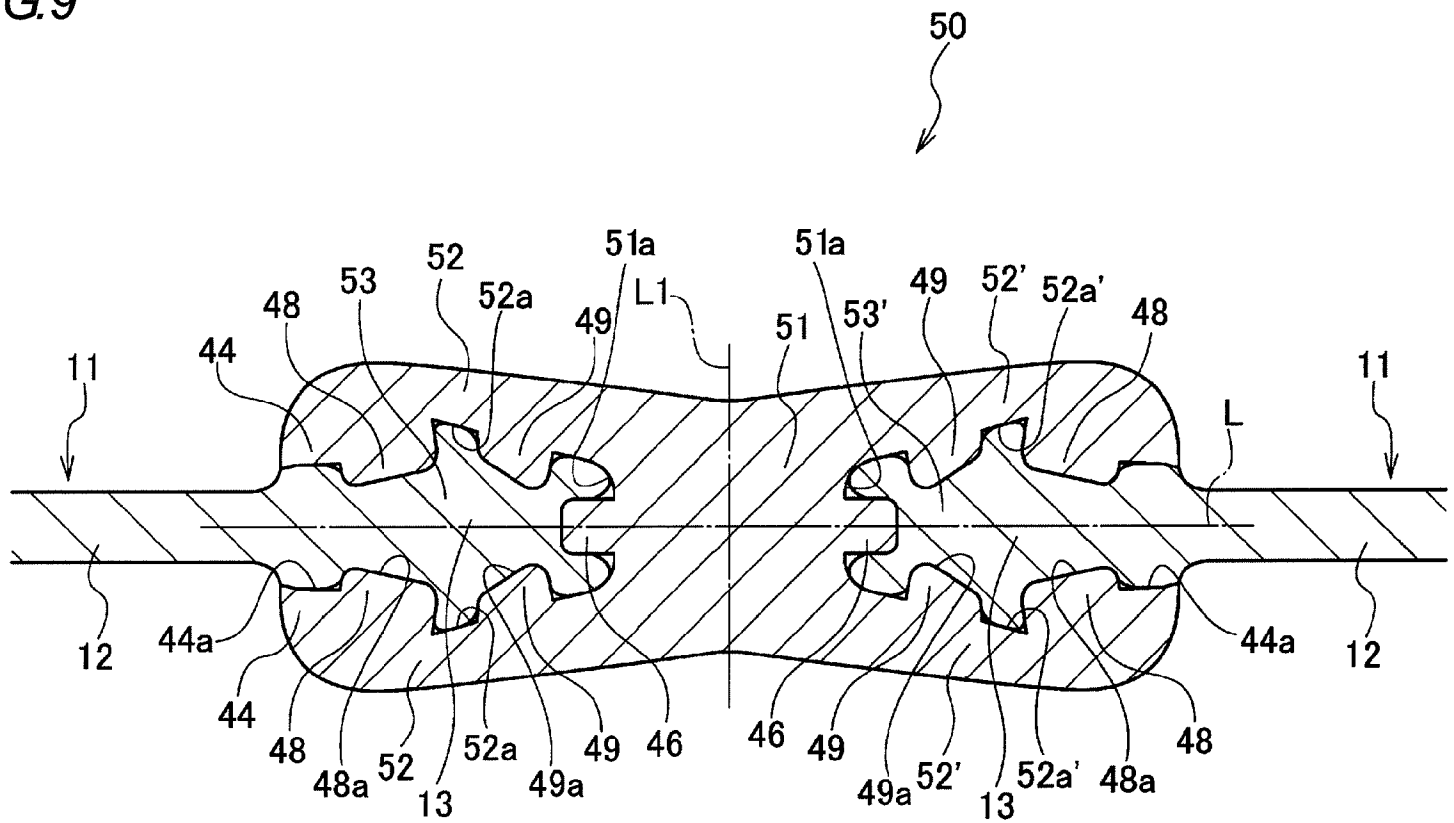
FIG. 9 is a cross-sectional view depicting the state in which the bottom end stop is attached to the core by being crimped.
Figure 10:
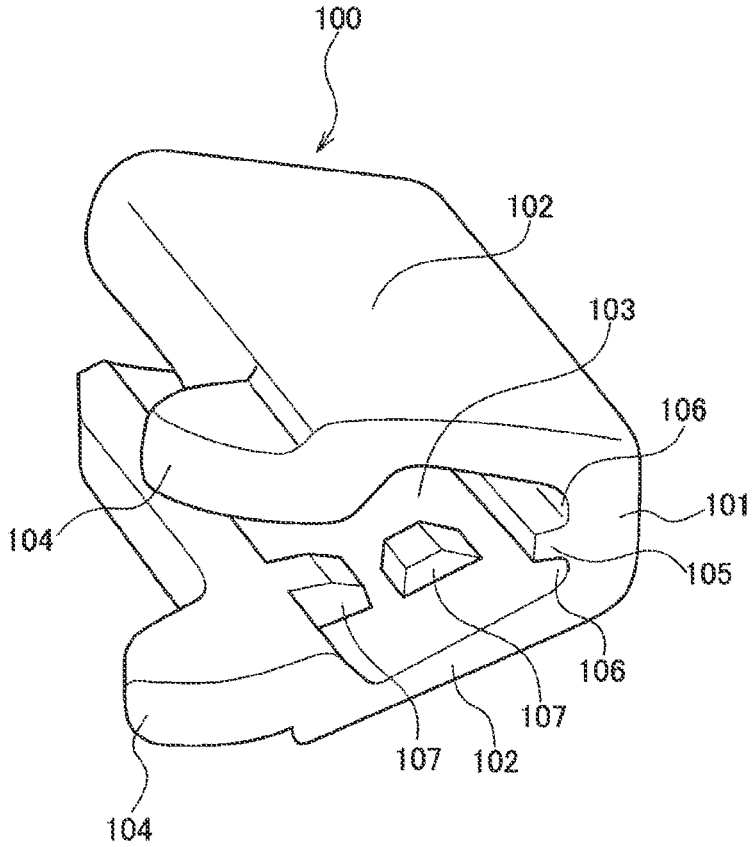
FIG.10 Prior Art
FIG. 10 is a perspective view depicting a top end stop that is known in the art.
Figure 11:
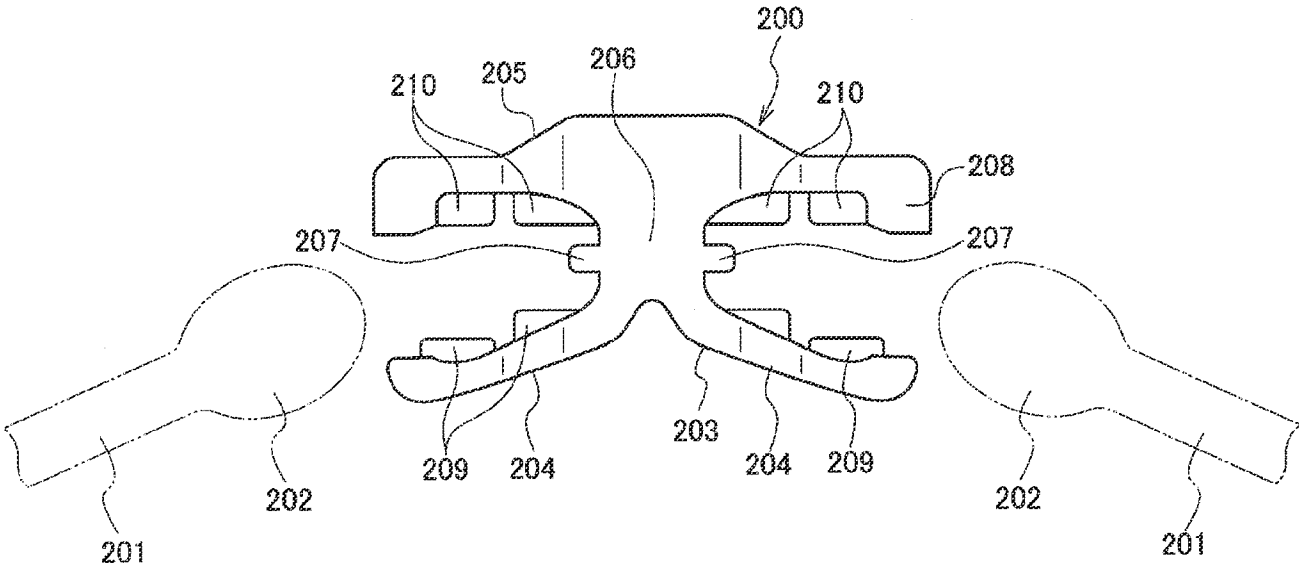
FIG. 11 is a view depicting the state before cores are inserted into another top end stop that is known in the art.

As shown in FIG. 8 and FIG. 9, the bottom end stop 50 includes a substantially flat base 51, which forms the central portion and has a predetermined length, one pair of legs 52, which extends in the same direction from the surface of the base 51 such that the legs 52 gradually expand from opposite longer edges of the base 51, another pair of legs 52', which is provided opposite to one pair of legs 52 and extends in the same direction from the surface of the base 51. The cross-section of the bottom end stop 50 is substantially H-shaped. That is, the cross-sectional shape of the bottom end stop 50 is symmetrical about line L that passes through the central portion of the base 51 such that the line L perpendicularly intersects the surface of the base 51, and is symmetrical about line L1 that passes the central portion of the base 51 along the surface of the base 41 (see FIG. 9). In addition, a receptacle 53, which is surrounded by an inner surface 51*a* of the base 51 and opposing inner wall surfaces 52*a* of one pair of legs 52, and a receptacle 53', which is surrounded by another inner surface 51*a* of the base 51 and opposing inner wall surfaces 52*a'* of another pair of legs 52', receive the cores 13 of the pair of left and right fastener tapes 11, respectively.

In the meantime, each of one pair of legs 52 and another pair of legs 52' is configured substantially the same as the pair of legs 52 of the first embodiment, except that the stop portions 45 are not provided. Each pair of legs 52 and 52' includes opening-side ends 44, a projection 46, a pair of protrusions 48 and a pair of protrusions 49.

Therefore, this can cause the same effects as in the first embodiment when setting the cores 13 of the fastener tapes 11 into the receptacles 53 and 53' of one and another pairs of legs 52 and 53, respectively, and in the subsequent crimping.

The present invention is not limited to the foregoing embodiments, but can be properly varied and improved.

Although each pair of legs 42 and 52 has been described as having one pair of protrusions 49 in the foregoing embodiments, each pair of legs 42 and 52 may have a plurality of protrusions 49, which are provided in plurality, in order to increase the amount of crimping. However, in the case of shaping the end stop 40, 50 via die casting, it is preferred that one protrusion be formed on each pair of legs 42, 52, in relation to the mold.

Furthermore, each opening-side side surface 48*d* of the pair of protrusions 48 (see FIG. 2A) may be formed on the boundary between the receptacle-defining portion 42*b* and the opening-side end 44 or extend toward the opening-side end.

Description of Reference Numerals

10 slide fastener
11 fastener tape
20 fastener element row
30 slider
40 top end stop (end stop for a slide fastener)
41, 51 base
42, 52, 52' leg
43, 53 receptacle
44 opening-side end
45 stop portion
46 projection
47 cavity
48 protrusion
48*a* inclined surface
49 protrusion
49*a* another inclined surface
50 bottom end stop (end stop for a slide fastener)

The invention claimed is:

1. An end stop for a slide fastener, comprising:
a base; and
at least one pair of legs which extend from the base,
wherein the end stop is formed with a receptacle which is surrounded by the base and the pair of legs,
wherein the pair of legs include:
a pair of opening-side ends which are provided opposite to the base;
a pair of first protrusions provided in the receptacle adjacent to the opening-side ends, each first protrusion protruding more inward into the receptacle than an adjacent opening-side end; and
a plurality of second protrusions formed on opposing inner wall surfaces of the pair of legs, the plurality of second protrusions protruding inward into the receptacle from positions between the base and the pair of first protrusions,
wherein the pair of first protrusions have first inclined surfaces which are configured such that a distance therebetween gradually increases from the opening-side ends toward the base, and
wherein the plurality of second protrusions have second inclined surfaces which are configured such that a distance therebetween gradually decreases from the opening-side ends toward the base.

2. The end stop for the slide fastener according to claim 1, wherein a distance between closest portions of the pair of first protrusions is shorter than a diameter of a core of a fastener tape.

* * * * *

UNITED STATES PATENT AND TRADEMARK OFFICE

CERTIFICATE OF CORRECTION

PATENT NO. : 8,776,330 B2
APPLICATION NO. : 13/518938
DATED : July 15, 2014
INVENTOR(S) : Keiichi Keyaki et al.

It is certified that error appears in the above-identified patent and that said Letters Patent is hereby corrected as shown below:

In the Specification

In column 5, line 8, delete “recepticle” and insert -- receptacle --, therefor.

In column 5, line 17, delete “al” and insert -- a1 --, therefor.

In column 5, line 22, delete “a of” and insert -- of --, therefor.

In column 5, line 53, delete “al” and insert -- a1 --, therefor.

In column 5, line 55, delete “a of” and insert -- of --, therefor.

In column 6, line 35, delete “a of” and insert -- of --, therefor.

In column 6, line 40, delete “al” and insert -- a1 --, therefor.

Signed and Sealed this
Twenty-first Day of October, 2014

Michelle K. Lee

Michelle K. Lee
*Deputy Director of the United States Patent and Trademark Office*